United States Patent [19]

Lapeyre

[11] Patent Number: 4,900,001

[45] Date of Patent: Feb. 13, 1990

[54] APPARATUS FOR PRINTING ON BOTH SIDES OF CONTINUOUS WEBS IN A FORMAT PRODUCING COLLATED STACKS OF ORDERED PAGES

[76] Inventor: James M. Lapeyre, P.O. Box 50699, New Orleans, La. 70150

[21] Appl. No.: 211,703

[22] Filed: Jun. 27, 1988

[51] Int. Cl.[4] ..... B41F 13/54

[52] U.S. Cl. ..... 270/1.1; 270/39; 493/320

[58] Field of Search ..... 270/1.1, 4, 5, 20.1, 270/39, 40, 41, 52, 52.5, 53; 281/2, 5 R, 15 R; 493/347, 411, 413, 320, 324, 325

[56] References Cited

U.S. PATENT DOCUMENTS

| | | | |
|---|---|---|---|
| 3,899,381 | 8/1975 | O'Brien | 156/204 |
| 3,952,311 | 4/1976 | Lapeyre | 354/4 |
| 4,194,832 | 3/1980 | Tabayashi | 270/1.1 |
| 4,524,993 | 6/1985 | Walker-Taylor | 281/15 R |
| 4,538,833 | 9/1985 | Trikilis | 281/2 |
| 4,758,021 | 7/1988 | Fukuda | 270/52.5 |

FOREIGN PATENT DOCUMENTS

| | | | |
|---|---|---|---|
| 0008325 | 1/1977 | Japan | 270/5 |

*Primary Examiner*—Robert E. Garrett
*Assistant Examiner*—Therese M. Newholm
*Attorney, Agent, or Firm*—Laurence R. Brown; Alfred J. Mangels

[57] ABSTRACT

A computerized printing system particularly advantageous with word processing and data retrieval with personal computers prints pages on both sides of sheets carried as a continuous web for collation of the sheets with the printed pages counting those on opposite sides of the sheets in numerically ordered sequence when stacked in a fan-fold type array. Printed pages are printed on both sides of the web, and batches of two consecutive pages are alternately printed on the opposite sides of the web. Corresponding data processing and organization means provide for organizing, printing and collating the data, which can process fan-fold type webs directly to produce pages stacked with pages on both sides of the separable web sheets oriented in the same direction in numerical sequence.

20 Claims, 5 Drawing Sheets

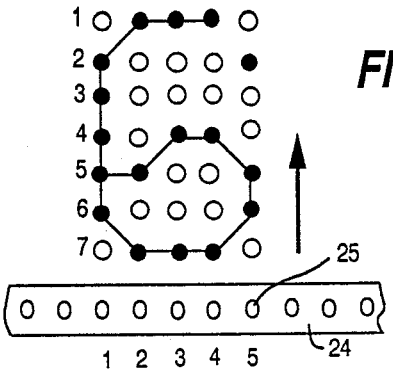
FIG. 5A
FIG. 5B
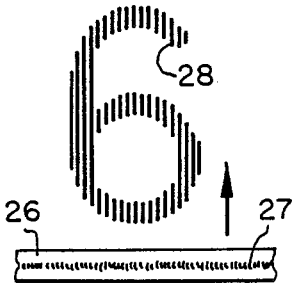
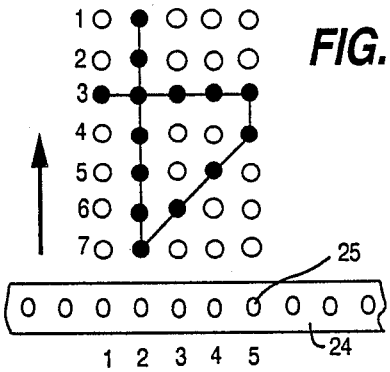
FIG. 6A
FIG. 6B
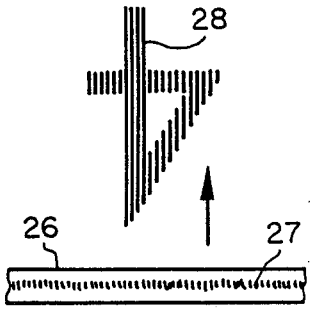
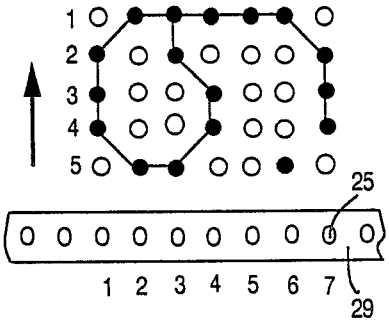
FIG. 10A
FIG. 10B
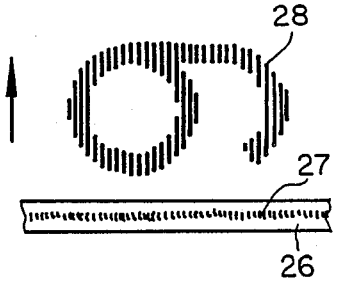

APPARATUS FOR PRINTING ON BOTH SIDES OF CONTINUOUS WEBS IN A FORMAT PRODUCING COLLATED STACKS OF ORDERED PAGES

FIELD OF THE INVENTION

This invention relates to computer controlled printing processing systems and more specifically it relates to apparatus for printing pages of computerized stored, formatted and collated data on both sides of continuous webs.

BACKGROUND ART

At this stage of the art, personal computers with associated systems and software are common for comprehensive word processing and data manipulation, and for formatting data into a proper form for direct printout onto continuous printable webs. Webs of printing paper are conventionally available with fan-fold structure having sheets defined by a disconnect structure such as preformed scoring along lines perpendicular to the edges of the web. Such fan-folded paper may be manually separated into separate sheets, or stacked in fan-fold fashion without separation from the continuous web. The computers and associated printers are programmed for processing data obtained from computer stores, either temporary as in the case of word processors, or permanent data banks in the case of data retrieval systems. Such data is conventionally retrieved from storage, organized into formatted batches compatible with various printers for presentation in page length batches and synchronized for printout with the feeding of the sheets identified in the webs.

In the printing arts, there are various commercial lines of printers operating in different modes to accept computer formatted instructions for printout of stored data. Such may be characterized in various ways including, impact printers and non-contact radiation controlled printers for printing on sensitized paper or the like. The formatting for various printers depends upon the printing methods employed, which may include, wheel printers timing the appearance of a character into print position, typewriters which choose a character presenting mechanism, and various types of printers which lay down a great number of small dots or stripes in groups which when viewed together create characters, symbols, charts, etc. The state of the art conventionally operates a wide range of printers of these various types.

In addition to the standard or traditional dot matrix printers, and raster type laser printers, one printing system of particular advantage in the present invention is that of my U.S. Pat. No. 3,952,311 issued Apr. 20, 1976 for Electro-Optical Printing System. This is a high-speed type-quality printer employing a large number of radiation type emitters, such as light emitting diodes (LED's) arranged in a line extending across a movable continuous web of radiation sensitive material to lay down a large number of parallel stripes or bands to form characters. Printed material is formatted by a computer that programs the emitters to form the desired patterns on the web as it moves past the line of emitters. With this printing system there is no need to stop the web for printing, and thus high printing speeds are available.

While these data processing, formatting, and printing systems are well developed and versatile, they still present significant unsolved problems.

One major such unsolved problem is the high web cost, and inefficient use of the web, particularly in the case of special radiation sensitive webs.

Another major such unsolved problem is that of printing on both sides of the web.

A still further major such unsolved problem is that of efficiently handling and collating multi-page printouts such as reports and booklets wherein the pages are printed on both sides.

It is therefore a general objective of this invention to provide improved computer controlled printer systems and resolve the foregoing problems. Other features, advantages and objects of the invention will be found throughout the following description, claims and drawing.

DISCLOSURE OF THE INVENTION

Improved computer printout systems are thus afforded that printout on both sides of continuous webs to produce therefrom collated stacks of ordered pages oriented in the same page direction and sequentially numbered counting both sides of the sheets in the stack.

To achieve this the electronic printer of my invention uses two printing heads and appropriate electronic control means for organizing data to be printed into page length batches of end-to-end or side-by-side pages in registration on opposite sides of a continuous web movable past the printing heads.

Computerized data retrieval from storage of coded data characters and the like by appropriate printer control circuits serves to formulate characters and organize them into page size batches distributed along the length of the web in a format that permits printed sheets to be separated and collated into stacks of sequentially ordered pages having information oriented in an upright position, and with the sequential page order counting both sides of the sheets in the stack. This permits binding stacks of pages at one boundary of the sheets.

The pages may be printed with two different printing orientations. According to the first orientation, the pages are printed end-to-end on the web with alternate pages right side up and upside down and with two successive pages of the ordered sequence alternated on opposite sides of the web. According to the second orientation, the pages are printed side-to-side on both sides of the web with two successive pages of the ordered sequence alternating on opposite sides of the web, and with one edge of the continuous web serving as the bottom of the pages for both sides. This serves to order the pages for collation by stacking pages in fan-fold order, which can result directly from the printer transport mechanism when handling fan-folded webs.

Thus printed out documents, which may be bound into booklets, are produced from continuous webs having sequential sheets therefrom separated, stacked and collated. When formulated from fan-fold webs having the sheets thereof stacked without disconnecting the sheets, trim and cut operations are required. For the first printing orientation, the trim and cut operations are performed on the respective top and bottom edges of the pages, and for the second printing orientation a trim and cut operation is performed at least at one edge of the pages. Registry of the edges of the web at forming the pages is easily achieved so that further trimming is not necessary.

Light emitting diode printers, or other equivalent printers symmetrically producing data on the web in two relatively opposite travel directions, are preferable to reduce the electronic formatting control system complexity, as the data is printed in the necessary orientation on successive pages on the web.

BRIEF DESCRIPTION OF THE DRAWINGS

Throughout the various views of the drawings, like reference characters refer to similar features to facilitate comparison. In the accompanying drawings.

FIGS. 5A and 5B illustrates how a "right-side-up" character such as the "6" in FIG. 4B may be formed as a traditional 5×7 dot matrix character or by the use of a single horizontal row of a large number of emitters that produce a multiplicity of bands or stripes of different lengths respectively.

FIGS. 6A and 6B illustrates how an upside-down character such as the "4" in FIG. 4A may be formed by a traditional 5×7 dot matrix technique or by the use of different length stripes or bands respectively.

FIGS. 10A and 10B illustrates how a character such as a "6" which has been rotated 90° counter-clockwise as shown in FIG. 9B, or a "9" rotated 90° clockwise as shown in 9A may be produced by a 7×5 dot matrix technique, or by a technique using different length stripes or bands respectively.

THE PREFERRED EMBODIMENTS

Figure 1:
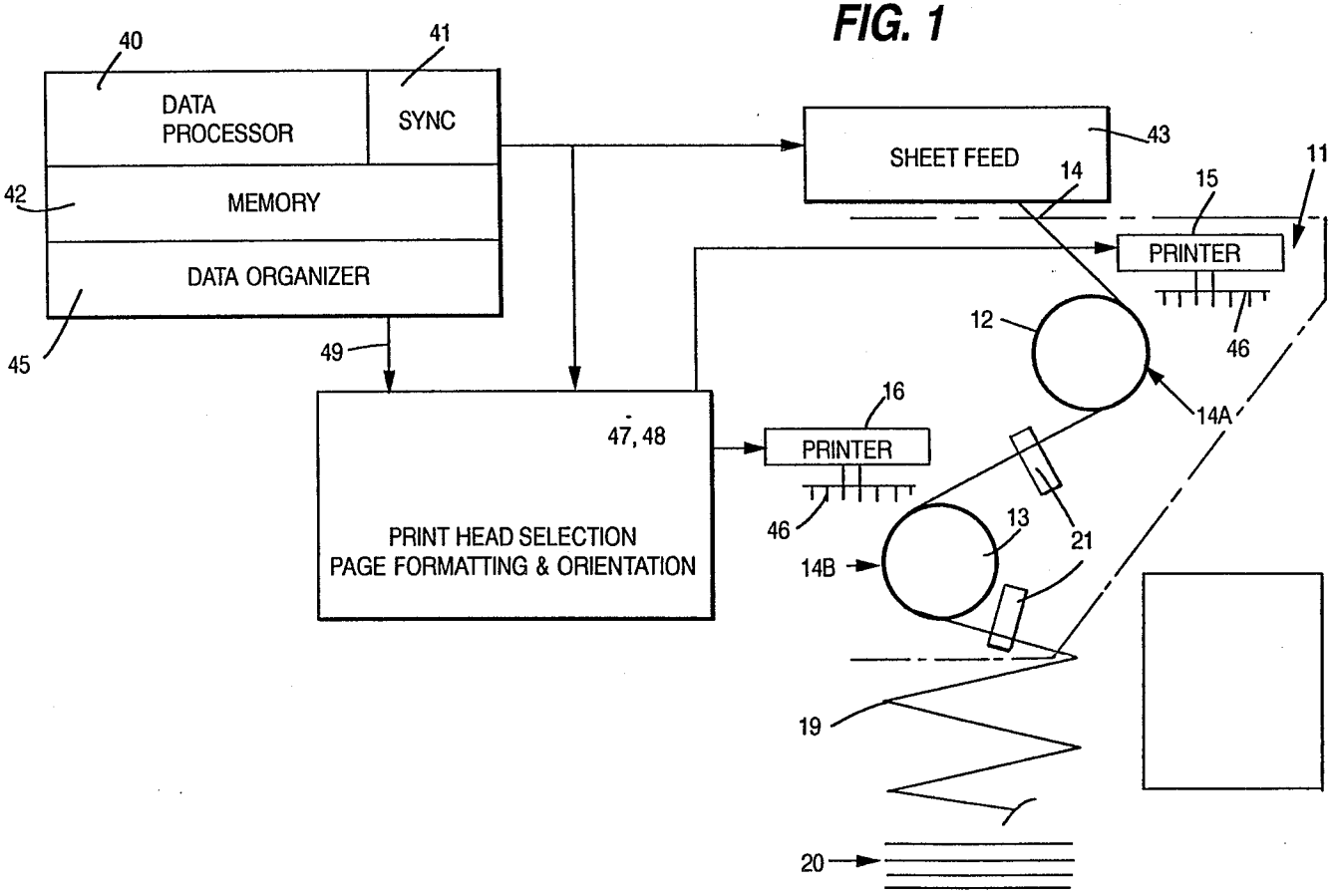
FIG. 1 is a block system diagram, partly in diagrammatic form, of a printer system embodying the invention.

The printer assembly 11 of FIG. 1 includes transport means, represented by feed rollers 12, 13, for passing the printable web 14 into the printing station in a path for printing thereon by the two printing heads 15, 16. These printing heads 15, 16 are located on opposite sides of the path of the web 14 to print on opposite sides 14A and 14B of the web. This feature conserves paper by printing on both sides and does this efficiently in a single pass of the web through the printer 11. However several critical precautions need be taken for operation in this mode.

Thus, the printer heads 15, 16 need be so spaced along the web path, and so programmed by organization and feeding of input data to the respective print heads that page length batches of data are printed in registry on opposite sides of the web, and are sequenced along the web in a particular manner to permit successive pages to be collated in an ordered sequence for numbering by consecutively counting both sides of the web sheets when stacked. The critical relationships will be better understood with reference to FIGS. 3, 4, 8 and 9, wherein the printing arrangements of the data on the web 14 is diagrammatically set forth by the page numbers 1 to 10.

Figure 3:
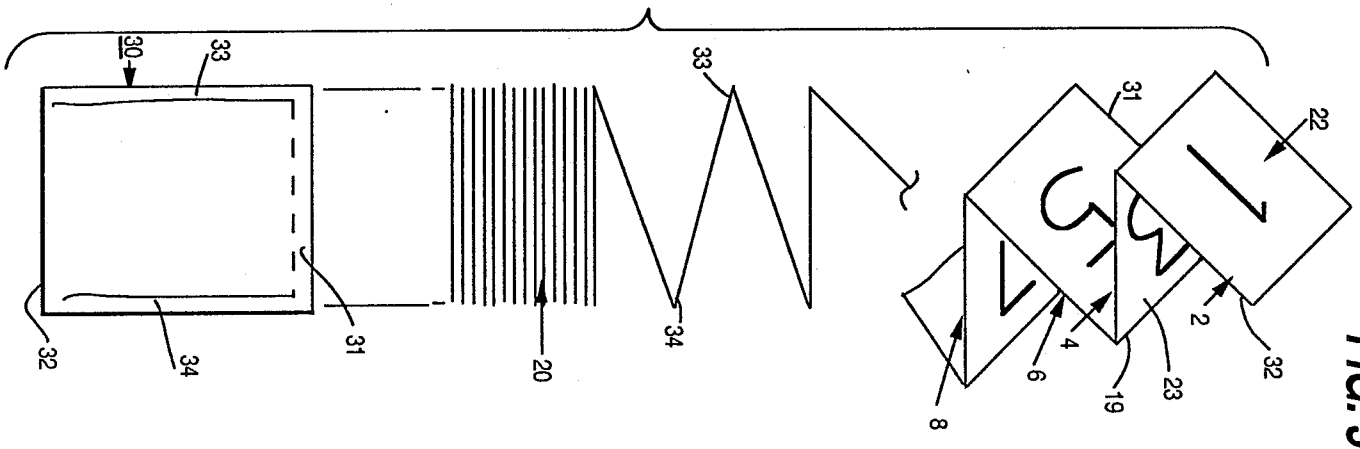
FIG. 3 is a sketch, partly in perspective, of a print-out stack of pages according to one printing orientation where the pages are sequentially ordered and arranged for trimming at the bottom and top edges and binding on a side edge to form a document in accordance with this invention.
Figure 8:
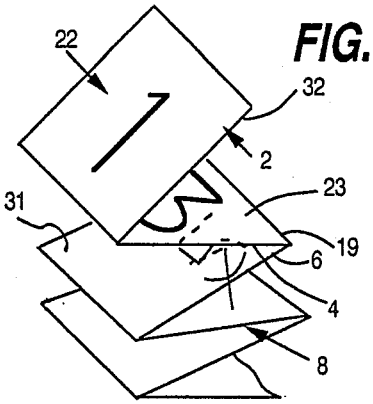
FIG. 8 is a sketch, partly in perspective, of a stack of pages printed according to a second printing orientation where the stack of pages are sequentially ordered and arranged for trimming on one side edge and binding on the other side edge.

As shown in FIG. 1, the web 14 needs to have sheets defined for receiving page size batches of data on the defined sheets at printers 15, 16. One conventional manner of doing this is to use a web preformed for fan-fold accumulation of designated sheets in a stack, as shown in FIGS. 1, 3 and 8, by means of perforations scored in the web which are perpendicular to the opposite edges of the web. These perforations result in folds 19 which permit the pages to be accumulated in a fan-fold stack 20. However, it should also be appreciated that means (not shown) may also be provided to fold and stack continuous non-scored webs, so as to stack sheets in the same ordered fan-fold type sequence, which is important to this invention. Also it will be appreciated that in certain types of electro-optic processes, such as for example xerography, one or more development stations 21 will be required. In the embodiment of FIG. 1 there is shown a development station 21 subsequent to print head 15 but before print head 16, and a second development station is shown subsequent to print head 16. In other printing processes, such as for example direct printing there will be no requirement for a development station 21 at all, or alternately only one development station subsequent to print head 16 will be required.

Figure 4:
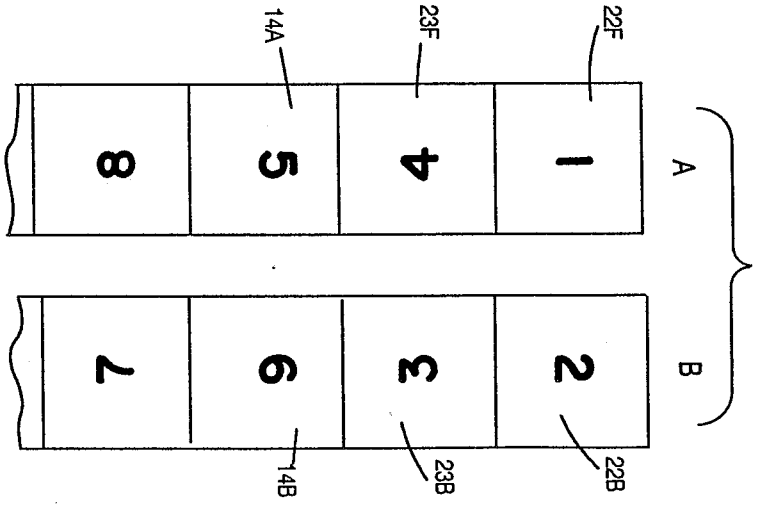
FIGS. 4A and 4B are respective diagrammatic sketches of the respective end-to-end formatting of page length batches of data on opposite sides of a continuous web for producing the printing orientation of FIG. 3.

With respect to the printing orientation shown in FIGS. 3 and 4, it can be seen that each sheet 22, 23, etc., located end-to-end along the web 14 will form front pages 22F, 23F, etc. and back pages 22B, 23B, etc., which receive page length batches of data thereon in printed form at the printing station 11. This printing is characterized simply in decimal character form 1 to 10 to show the ordered sequence in which such pages are printed and collated, and to show that the printing on some pages is right side up and on other upside down. In actual use, of course, complete page size batches of alphanumeric information would typically be printed on each page rather than a single number. From FIG. 4 it is evident that the pages on each side of the web (FIG. 4A and FIG. 4B respectively) are printed alternately right side up and upside down. Also the printed sequence format on each side locates two successive pages of the assembled stack, such as 2,3 or 4,5, on two successive sheets of the web. Thus batches of two successive pages in the ordered collated sequence 1, 2, 3, etc. are alternated on opposite sides of the web that is continuously presented at the printing station 11.

Thus, by collating the consecutive sheets presented by the continuous web 14 in the fan-folded type order represented by stacks 20, an ordered sequence of consecutive pages results as necessary for assembly into booklets or the like with printing on two sides of each sheet. As seen from the diagrammatic top view 30 of the fan-fold sequence stack of sheets resulting from a web having fan-fold disconnect or fold lines scored therein, the sheets may be bound into a booklet along one edge 31 that coincides with one edge of the web, as indicated by the dotted stitch or glue line. It is easy to carefully register these opposite sheet (web) edges 31, 32 (which constitute the top and bottom page edges) so that no trimming is necessary. When the web sheets are not disconnected at the scored fold line in the stack 20, the folded over edges may be trimmed in conventional book binding fashion as indicated on the side edges 33, 34 of the stacked pages by the wavy lines along multiple fold line portions 33, 34 delineating the sheets.

This page orientation and printing sequence is unconventional as seen by comparison with U.S. Pat. No. 4,193,832, Mar. 25, 1980 for Consecutive Copying and Bookbinding Method and its Apparatus, since formerly pages had to be printed right side up and thus would be unnaturally printed in a way incompatible with production from personal computer work processing type of equipment for which this invention is ideally suited.

It will be appreciated that various types of print heads may be used with this invention. One example, of course, is a traditional 5 ×7 dot matrix print head or alternately a 5 dot bar or line for each character. Selected ones of the "5" dots or elements are turned on for each character as the paper or web advances to 7 different locations. Thus, instead of having a two dimensional 5×7 printing matrix, a single row of "5" printing elements may be used and selectively activated 7 times to achieve the traditional 5×7 character. Referring now to FIG. 5A there is illustrated how the number "6" could be printed by a single row of "5" printing elements which are selectively turned on 7 times as the web or paper moves past the single row. As shown the row of 5 printing elements are on a single support member 24. As an example each printing element is indicated by a small pin or light emitting diode 25. Above member 24, there is shown a 5×7 dot array which clearly illustrates vertical positions 1–7 and horizontal positions 1–5. This 35 dot 5×7 matrix is what would be printed if all 5 printing elements were turned on for each of the 7 positions. However, as shown by the shaded dots, to create the number "6" only the printing elements 2 through 4 are activated at position 1, only elements 1 and 5 at position 2, only element 1 at position 3, only elements 1, 3, 4 and 5 at position 4, etc. until the entire "6" is created as shown.

Alternately a type-quality or high-quality print which is particularly useful with this invention may be created by the technique of laying down a very large number of bands or stripes of different lengths which when viewed together form symbols or characters. This technique is clearly set forth in my U.S. Pat. No. 3,952,311. For example, as shown in FIG. 5B an array 26 of at least one row of a multiplicity of light emitters 27 such as LED's or the exit ends of optical fiber such as Selfoc ® lenses selectively irradiate light sensitive paper or a photosensitive web as the web or paper moves past exposed areas such for example as band or stripe 28. As will be appreciated by anyone skilled in the art, the bands or stripes may be created by a great number of overlapping dots which can occur from either programming or strobing, or by simply starting the band or stripe at one selected position and stopping it at another selected position.

However, as is clearly seen in FIGS. 4A an 4B every other sheet on each side of the web is printed upside down so that when the fan-folded stack of sheets are bound and trimmed, the information on the pages is all right side up. FIGS. 6A and 6B illustrates how the upside down "4" of FIG. 4A may be formed by a 5×7 dot matrix technique or the stripe or band technique of U.S. Pat. No. 3,952,311 respectively. As can be seen, the techniques shown in FIGS. 6A and 6B is exactly the same as shown in FIGS. 5A and 5B except that all of the characters will be printed upside down and the page will be printed from the bottom to the top.

Figure 9:
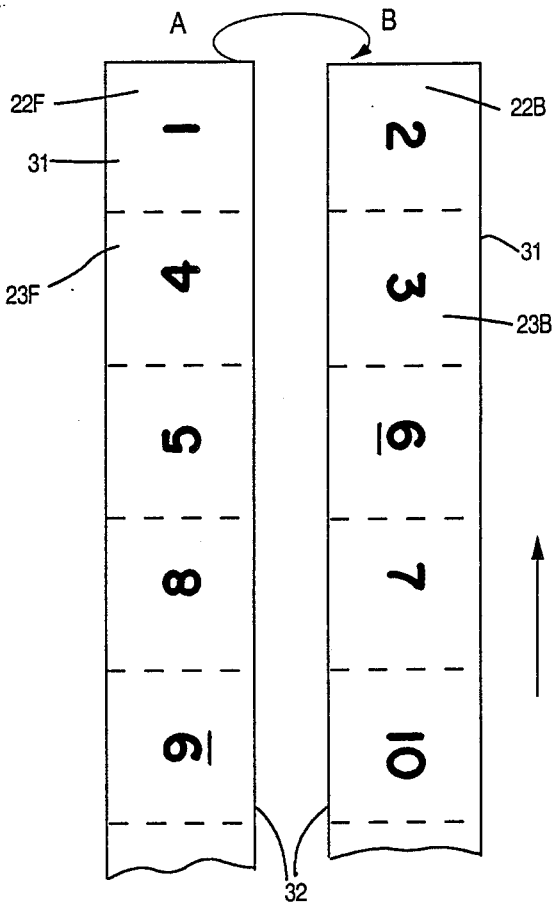
FIGS. 9A and 9B are respective diagrammatic sketches of the side-to-side formatting of data on both sides of a continuous web for producing the printing orientation of FIG. 8.

In addition to the page or information batch orientation on the web as shown in FIGS. 3 and 4, the information may also be orientated in the manner shown in FIG. 8 and 9. As shown, the data is printed on the transport paper or web in side-by-side batches such as shown in FIGS. 9A and 9B. As can also be seen, according to this techniques the top of the page is always edge 31, on both the front pages (i.e. 22F, 23F, etc.) and the back page (i.e. 22B, 23B, etc.). Note that the same reference numbers have been used in both the embodiments of FIGS. 3 and 4 as well as the embodiments of FIGS. 8 and 9 to designate the same edges of the web and the same "sheets" of the web. According to this technique, however, it may only be necessary to trim the web at the folds on the right hand side rather than at both the top and bottom as required in the techniques shown in FIGS. 3 and 4. This is possible of course since the stack of pages will typically be bound on the left hand side of the resulting document.

It should be noted, however, that to produce the batches of page data with a side-by-side orientation on fan-fold webs as shown in FIGS. 8, 9A and 9B, the data must be printed from side-to-side rather than from top to bottom or bottom to top. FIGS. 10A and 10B illustrate how a "6" rotated clockwise 90° and as shown in FIG. 9B or a "9" rotated counter-clockwise 90° and as shown in FIG. 9A could be printed by a 7×5 dot matrix technique or the stripe technique of U.S. Pat. No. 3,952,311. It should be specifically noted that a 7×5 matrix rather than a 5×7 matrix is used in FIG. 10A. That is, member 29 supports a single row of 7 printing elements rather than 5 printing elements, and the 7 elements are selectively activated 5 times rather than 7 times. Thus, although either a "6" rotated clockwise 90° and a "9" rotated counter-clockwise 90° are illustrated as being printed by FIGS. 10A and 10B, it should be appreciated that all pages printed on the front of a sheet (such as shown in FIG. 9A) will be rotated 90° counter-clockwise, and all pages printed on the back of a sheet (such as shown in FIG. 9B) will be rotated 90° clockwise.

The printing system of this invention then contemplates also an unconventional data retrieval, data processing, printer control and printed data formatting interaction to achieve the foregoing organization of the printed data, as illustrated by the block diagram data processing embodiment of FIG. 1, by way of example. Therein the data processing system 40, having synchronization means 41, programs and controls the interaction of the memory 42, in which the data to be printed is organized and stored, and the printer system 11 with its sheet feed locating and positioning means 43 portion of the web transport means. That portion, as in most conventional computer printout systems, keeps track of the sheet positions on the web 14 and organizes page lengths of data thereon at the printer system 11. In this system, that is done for each print head 15, 16 so that the printing of the corresponding page length batches of data for opposite sides of the web is properly registered in place on the web as it travels through the transport path past the printer heads.

The remainder of the FIG. 1 system, constituting means for storing data and feeding it in formatted relationship to the two printer heads, relates to retrieval of data for printout, selection of one of the two print heads for a particular page of data and the organization of that data for printing on the two sides of the web 14. For this purpose attention is called to the more difficult format representation of FIG. 4A, wherein alternate pages on the same side of the web are alternated in upside down and right side up relationship. Depending upon the type of printer head, this is handled in different ways. Thus, if a traditional dot matrix character is fully formed at one time by an array of dot printing elements, the data organizer 45 may need to reform the character data so as to print the characters and the lines upside down. That can be done by data manipulation such as by programming automatic selection of two different printing formats as required for each successive page. Many printer systems have the capability to change printing formats at will.

Figure 7:
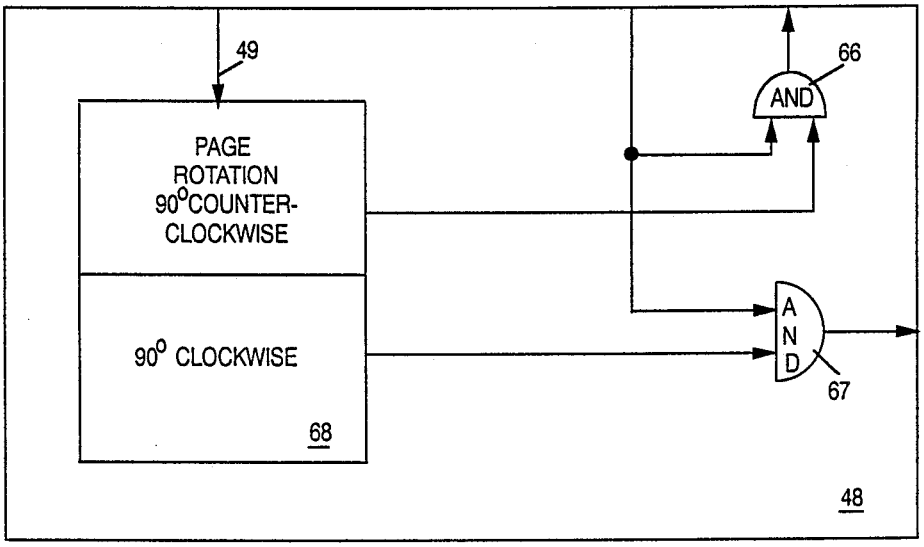
FIG. 7 illustrates a block diagram circuitry for a second embodiment of the invention.

However, if the printing heads constitute a single line of either standard dot matrix or band print elements, or some other type of individually actuable printing elements, the data may be more simply organized and thus there is a preference for this type of printer head as suggested by reference number 46. For faster printing, the multiplicity of printing elements extend across the page in a straight line, and are of the radiation emitting type, hereinbefore discussed. By using this type printing head, the web may be continuously advanced without starting and stopping for the printing. Also the simplicity of handling data will become evident from the following discussions of two possible formatting means illustrated in FIGS. 2 and 7. As can be seen, data leaves Data Organizer 45 and is provided to the "Print Head Selection And Page Forwarding or Orientation Circuitry" 47 or 48 by means of data line 49 for either the embodiment of FIG. 2 or FIG. 7 respectively.

Figure 2:
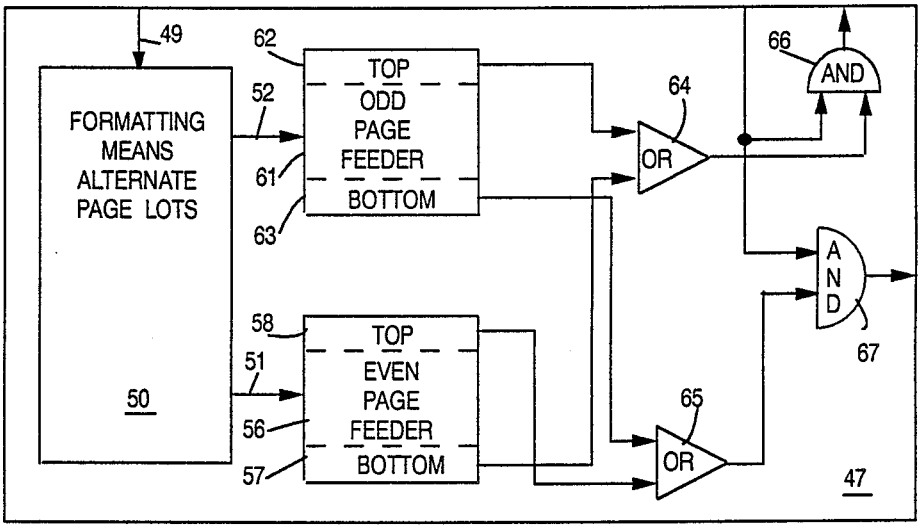
FIG. 2 illustrates block diagram circuitry for a first embodiment of the invention.

More specifically, and as shown in FIG. 2, the batching of data into page length lots, which may be alternately processed for upside down printing, as required by the embodiment of FIG. 3, is achieved in the formatting means 50. Thus, the data for even pages flow along line 51 and the data for odd pages along line 52. Note on FIG. 4 that odd pages are upside down on the back of the web while even pages are upside down on the front of the web. Thus assume printer head 15 to be the front of the page printer and printer head 16 to be the back of the page printer.

Even page feeder 56 feeds pages from the top 58 or bottom 57 respectively to the backside print head 16 and the front side print head 15, thus to format the data on the even pages for printing in the sequence and direction of FIG. 4. Pages 2 and 6 on the backside (FIG. 4B) will thus appear right side up and pages 4 and 8 on the front side (FIG. 4A) will be upside down. Similarly odd page feeder 61, by way of top feed 62 and bottom feed 63 will format the odd pages. "OR" mixers 64, 65 channel the proper data print signals to the print heads through "AND" gates 66 and 67 at the times controlled by the computer 40 via sync timing section 41.

With respect to the embodiment of FIGS. 2, 3 and 4, the printer feeders 56, 61 for the preferred single line type printer 15, 16 could simply be shift registers synchronized with non-stop web travel to actuate the line of printing elements with the desired data printing signals, which could be printed type or other character symbols or patterns as desired. With respect to the embodiment of FIGS. 7, 8 and 9, it is only necessary that the page be rotated 90° prior to printing as indicated by "Page Rotation" circuitry 68. However, in the embodiment shown, 90° counter-clockwise rotation is necessary for printing on the front of the web, and 90° clockwise rotation is required for printing on the back of the web. A common way to format pages for printing is by a "bit map", that is the page is subdivided into small picture elements or "Pels" on the order of about 300 or more "Pels" per inch in both directions. For normal printing to produce a positive image, the "Pels" are read out in rows right to left. However, to rotate the page 90° clockwise, it is necessary that the Pels be read out in columns from bottom to top and left to right. To rotate the page 90° counter-clockwise the Pels are read out top to bottom and right to left. This page rotation will match the data to be printed with the required page sequencing and registration relationships. It should also be understood that the method of reading Pels from the bit map may necessarily be different depending on whether a "positive" or "negative" image is to be placed on the recording medium.

This invention therefore provides an improved computer controlled printer system for printing on both sides of a printable web, which may be advantageously employed to print on both sides of a continuous web end-to-end pages that are simply collated for sequential pagination by stacking sheets along the web in fan-fold fashion. Thus, sheets printed on both sides stacked in fan-folded array are produced in sequential pagination for binding into booklets along a side edge, if desired.

Having therefore set forth the novel features of the invention, they are set forth with particularity in the following claims to indicate the spirit and nature of the invention.

I claim:

1. An electronically controlled computerized printer system for printout on both sides of continuous webs to produce therefrom collated stacks of ordered pages, comprising in combination;

two printing heads with corresponding interconnected data processing means for producing from stored data printed text on opposite sides of a printable medium;

a continuous printable web representing a series of similar sized stacked sheets positioned together into said continuous web, said web including two multiple fold line portions to delineate said series of similar sheets, each multiple fold-line portion substantially perpendicular to the opposite edges of said web;

means for feeding said web in a path past the two said printer heads so as to print onto opposite sides of the web sheets;

means for storing data and feeding to each printing head a sequence of page data batches to be printed in ordered format in registration on both sides of the web on successive sheets along the web and arranged in a sequence for presentation of successive pages in a sequentially page numbered format counting both sides of the sheets when the sheets are stacked in a fan-folded order; and means for synchronizing and locating data to be printed on the successive sheets of the web in said ordered format with the presentation of the sheets of the web to the respective printer heads, including means for presenting and printing data on both sides of the web alternately printing pages right side up and upside down on the same side of the web;

thereby to print out on the web for arrangement into a fan-folded order in a stacked array of properly oriented sheets, numbered consecutively on both sides of the sheets, and which can be bound at one of the boundaries of the stacked sheets to form a booklet with individual accessible sheets by separating said sheets at, at least one of said multiple fold line portions.

2. The printer system of claim 1 wherein the stacked sheets are bound on one edge of the web and the two multiple fold line portions are at the bottom and top of the pages and the sheets are separated at both of the two multiple line positions.

3. An electronically controlled computerized printer system for printout on both sides of continuous webs to produce therefrom collated stacks of ordered pages, comprising in combination; two printing heads with corresponding interconnected data processing means for producing from stored data printed data on opposite sides of a printable medium; a continuous printable web presenting a series of similar sized sheets positioned in sequence along the web with two multiple fold line portions perpendicular to opposite edges of the web delineating separate sheets; means for feeding said web in a path past the two said printer heads to print therefrom onto opposite sides of the web sheets; means for organizing and feeding said stored data to each printing head in a sequence of page data batches to be printed in ordered format in registration on both sides of the web on successive sheets along the web and arranged in a sequence for presentation of successive pages in a sequentially page numbered format counting both sides of the sheets when the sheets are stacked in a fan-folded order; and computerized means for advancing the web automatically at a substantially uninterrupted predetermined computer controlled printing speed past the printer heads over a printing operation to synchronize and locate computer controlled batches of data to be printed on the successive sheets of the stack in ordered registration wherein said two multiple fold line portions are two multiple disconnect portions.

4. The system of claim 3 further comprising:

said web constituting a fan-fold array with folds arranged at said disconnect lines with the printed pages fan-folded into a stack, wherein:

the two folds encompass the left hand and right hand boundaries of the stacked pages, and the pages of the stack are fastened together along one of the two folds of the stacked pages such that trimming may be confined to the fold opposite the fold where the stacked pages are fastened.

5. The system of claim 3 further comprising, said printing heads being of a type that symmetrically prints the stored data without reorganization of printing format as the data is alternately printed upside down and right side up.

6. An electronically controlled computerized printer system for printout on both sides of continuous webs to produce therefrom collated stacks of ordered pages, comprising in combination; two printing heads with corresponding interconnected data processing means for producing from stored data printed data on opposite sides of a printable medium; a continuous printable web presenting a series of similar sized sheets positioned in sequence along the web with two multiple fold line portions perpendicular to opposite edges of the web delineating separate sheets; means for feeding said web in a path past the two said printer heads to print therefrom onto opposite sides of the web sheets; means for organizing and feeding said stored data to each printing head in a sequence of page data batches to be printed in ordered format in registration on both sides of the web on successive sheets along the web and arranged in a sequence for presentation of successive pages in a sequentially page numbered format counting both sides of the sheets when the sheets are stacked in a fan-folded order; and computerized means for advancing the web automatically at a substantially uninterrupted predetermined computer controlled printing speed past the printer heads over a printing operation to synchronize and locate computer controlled batches of data to be printed on the successive sheets of the stack in ordered registration wherein consecutive page data batches are printed side-by-side, with the same edge of the web serving as the top of the data for all of the consecutive page data batches such that the stacked sheets can be bound at one of the two multiple fold line portions, and sheets are separated at the other multi-fold line portion.

7. A multi-sheet printout from a printer system printed on both sides of a continuous web wherein sequential pages are printed end-to-end and alternately right side up and upside down on opposite sides of separable sheets along the web in batches of two successive pages alternated on opposite sides of a continuous web assembly, which web assembly has sheets definable therein which are stackable in fan-folded array for providing a plurality of sequential pages arranged with printed data on all sheets right side up on both sides of the sheets.

8. A printout as defined in claim 7, further comprising, fan-fold structure in the web defining said sheets with the sheets connected together in the fan-folded array having sides of the pages registered along the two edges of the web to permit fastening together and manual turning of the pages after removal of the top and bottom fan-fold structure of the stacked sheets.

9. A data processing system for printing from stored data onto pages located on both sides of a continuous web and collating the printed pages into a plurality of sequentially numbered pages counting those on the front and back sides of the web, comprising in combination;

data processing means for organizing and storing data into a format for printing of a sequence of pages to be arranged in registry on the opposite sides of the web;

a web containing a multiplicity of sheets connected together end-to-end along the web and separable at disconnect lines disposed between successive sheets and arranged perpendicular to opposite edges of the web;

web feeding means for transporting said web to a printing station;

printing means located at the printing station electronically coupled with the data processing means to reproduce in printed form the pages on opposite sides of the web, said printing means comprising a pair of printing heads located respectively on opposite sides of the web being transported and disposed for printing in registry pages located on opposite sides of said sheets as the web passes the printing heads; and means for formatting data to be presented to the respective printing means for printing the pages on each side of the web on sequential sheets of the web, whereby the web is printed into a format for the sheets to be transported by said transportation means to a delivery station and stacked in a fan-folded type sequence that can be fastened together in registry and having the pages presented in sequential order right side up when counting pages on both sides of the sheets in order, said web constituting a fan-fold array with folds arranged at said disconnect lines with the printed pages fan-folded into a stack, wherein the pages in said stack are fastened together along one edge of the stack coinciding with one of the web edges, and the top and bottom ends of the pages in the stack encompassing the folds are removed, thereby confining trimming to two edges.

10. The system of claim 9 further comprising, said printing heads constituting line printers of the type having a single row of separated image producing elements.

11. The system of claim 9 further comprising, means for arranging the format of the data to be printed including means for storing elements of printed text in a bit map as a multiplicity of sequentially producible picture elements for actuating said image producing elements.

12. The system of claim 9 further comprising, printing heads of the type which use an array of a multiplicity of radiation emitters, wherein the web is of a radiation sensitive type responding to radiation emitted from the multiplicity of elements of the printing heads.

13. The system of claim 9 further comprising, printing heads of the type that reproduce a printed image directly upon the web sheet surface in response to the organized data presented to the printing means by said means for organizing data.

14. The method of printing pages on both sides, of a continuous web with computer controlled electronic printing means and collating the pages into sequential order, comprising in combination the steps of:

feeding a continuous web of paper to be printed past a printing station;

printing at the printing station data on both sides of the web as it is fed past the printing station;

storing, organizing and presenting data to the printing station in page size batches sequence along the web and timed for printing pages in registration on the opposite sides of the web, with pages formatted sequentially along both sides of the web;

segregating, stacking and collating the pages presented along the length of the web in a fan-fold type stack with an ordered sequence of pages when counting both sides of the pages, feeding a web having sheets defined sequentially along the web by means of fan-fold structure, registering the printing of the pages with the sheets defined by the web, and thereby collating the pages by arranging the web in a fan-folded stack, and wherein said pages formatted sequentially along both sides of the web are alternatively right side up and up-side down, and further comprising the steps of, fastening the stacked sheets together along one side of the web, and cutting off from the fan-folded stack the fan-fold structure holding the sheets together in a web at the top and bottom edges of the sheets.

15. The method of printing pages on both sides of a continuous web with computer controlled electronic printing means and collating the pages into sequential order, comprising in combination the steps of:

feeding a continuous web of paper to be printed past a printing station;

printing at the printing station data on both sides of the web during movement under computer control at a predetermined computer controlled web advancing speed past the printing station;

storing, organizing and presenting data to the printing station in batches to be oriented on separate pages allocated in sequence for printing along the web length during said movement in registration with a sequence of pages positioned along the length of the web under computer control;

stacking and collating the pages sequentially presented along the length of the web in a fan-fold type of stack thereby sequencing the pages in a numerical page order as presented in said stack when viewing both sides of the pages;

orienting the batches of page sized data such that one of the web edges serves as the top side of the data for pages on both sides of the web;

fastening the stacked sheets together along the fan-fold structure which holds the sheets together on one side; and cutting off from the stack the fan-fold structure holding the sheets together which is opposite the fastened side of the sheets.

16. The method of printing pages on both sides of a continuous web with computer controlled electronic printing means and collating the pages into sequential order, comprising in combination the steps of:

feeding a continuous web of paper to be printed past a printing station;

printing at the printing station data on both sides of the web during movement under computer control at a predetermined computer controlled web advancing speed past the printing station;

storing, organizing and presenting data to the printing station in batches to be oriented on separate pages allocated in sequence for printing along the web length during said movement in registration with a sequence of pages positioned along the length of the web under computer control;

stacking and collating the pages sequentially presented along the length of the web in a fan-fold type of stack thereby sequencing the pages in a numerical page order as presented in said stack when viewing both sides of the pages; and sequencing printed pages on both sides of the web in an ordered array of sequential batches of two successive pages.

17. The method of claim 16 including the step of removing fan-fold structure on one side of the sheets.

18. The method of claim 17 and further comprising the step of orienting the data batches so that they are printed side-by-side with the same edge of the web serving as the top of the data batches on both sides of the web.

19. The method of printing on both sides of a continuous web data in registry in a format of pages printed on opposite sides of the web into designated sheet locations for assembly into a stack of similarly oriented pages of numerically ordered sequence when counting pages on opposite sides of successive sheets;

comprising the steps of presenting and printing page size batches of data in registration on opposite sides of the web sheets on a sequence of sheets defined along the length of the web, in an order along the web that arranges the data into sequential pages counting the opposite sides of successive sheets in order when the sheets are stacked in a fan-folded manner, and alternately printing the data batches right side up and upside down on said sequence of sheets defined along the length of said web.

20. A printer system comprising in combination; means for transporting a continuous web of a printable medium through a printing station, a pair of electronically controllable printing heads for forming on the web printed character patterns in response to coded electronic signals from a computer system, said heads being located at the printing station on opposite sides of the path of the web to print on opposite sides of the web, computer controlled electronic data retrieval and processing means coupled to produce with the printing heads printed character patterns on the web responsive to data retrieved from said data retrieval means and further means responsive to said data processing means for formulation of electronic control signals to the printing heads and web transport means for formatting and printing said character patterns on both sides of the web in registry to form multi-paged sequences spaced along the length of the web comprising data of page sized batches ready for separation from the web and collation into a stacked sequence of ordered pages having character patterns thereon oriented end-to-end.

* * * * *